US006319388B1

(12) United States Patent
Piron et al.

(10) Patent No.: US 6,319,388 B1
(45) Date of Patent: Nov. 20, 2001

(54) METHOD OF MANAGING THE OPERATION OF A PLANT FOR THE PRODUCTION OF ALUMINIUM BY IGNEOUS ELECTROLYSIS AND ALUMINIUM PRODUCTION PLANT FOR IMPLEMENTING THIS METHOD

(75) Inventors: Gérard Piron, Lyons; Serge Huon, Loffre, both of (FR)

(73) Assignee: ACIS, Lofre (FR)

( * ) Notice: Subject to any disclaimer, the term of this patent is extended or adjusted under 35 U.S.C. 154(b) by 0 days.

(21) Appl. No.: 09/456,974

(22) Filed: Dec. 7, 1999

(51) Int. Cl.[7] ..... C25C 3/06
(52) U.S. Cl. ..... 205/389; 205/392; 204/245
(58) Field of Search ..... 204/245, 244; 205/389, 392

(56) References Cited

U.S. PATENT DOCUMENTS 6,153,066 * 11/2000 Piron ..... 204/245

FOREIGN PATENT DOCUMENTS 0 618 313 10/1994 (EP) .
9914580 11/1999 (FR) .
1 028 084 8/2000 (FR) .

* cited by examiner

*Primary Examiner*—Kathryn Gorgos
*Assistant Examiner*—Thomas H Parsons
(74) *Attorney, Agent, or Firm*—Knobbe, Martens, Olson & Bear, LLP

(57) ABSTRACT

This method of managing the operation of a plant for the production of aluminium by igneous electrolysis, of the type having a set (2, 3) of two electrolysis tankrooms, each having a series of tanks, the tankrooms being mutually parallel and symmetrical with respect to a central passageway (4) in which the handling of the liquid-aluminium tapping ladle is carried out, consists in carrying out the various handling operations at each of the tanks, necessary for the operation of the plant, in a closed loop, the members (13, 13', 13", 13'", 14, 14', 14", 14'") needed for the operation being moved over all the tanks of the two tankrooms of continuous cycles. The invention also relates to the plant for implementing this method.

13 Claims, 3 Drawing Sheets

METHOD OF MANAGING THE OPERATION OF A PLANT FOR THE PRODUCTION OF ALUMINIUM BY IGNEOUS ELECTROLYSIS AND ALUMINIUM PRODUCTION PLANT FOR IMPLEMENTING THIS METHOD

BACKGROUND OF THE INVENTION

1. Field of the Invention

The invention relates to a method of managing the operation of a plant for the production of aluminium by igneous electrolysis. It also relates to the plant for implementing this method.

It relates more particularly to the management of the tools needed to operate such a plant, and especially to the lifting tools, handling tools, etc. conventionally employed in plants of the type in question.

2. Description of the Related Art

It is known that the production of aluminium by igneous electrolysis employs an alumina electrolysis reaction in a bath of molten cyrolite according to the reaction:

$$Al_2O_3+2e+Na_3[AlF_6]\rightarrow 2Al+3O_2+3C\rightarrow 3CO_2+F \text{ alumina cryolite}$$

This reaction uses a molten bath comprising a mixture of cryolite and alumina, the temperature of which is generally greater than 800° C. On account of the energy used and in order to limit the losses inherent in the start-up phases as far as possible, aluminium production plants employing this technology generally operate continuously with a series of aluminium tanks, the number and size of which depend, on the one hand, on the available amperage of the direct current supplying the tanks and, on the other hand, on the desired production quantity.

Moreover, plants are frequently organized in such a way that they have a number of tanks in series, mounted parallel to each other and installed within the same building or in separate buildings placed symmetrically with respect to a central passageway which is intended, in particular, to allow handling of the ladles containing a bath of molten cryolite for the electrolysis tanks, the beams for lifting the anode frames and other movements of the tank accessories, and which is more particularly intended for the handling of crucibles for tapping off the molten aluminium obtained by electrolysis.

Such series of electrolysis tanks may extend over relatively large distances, which may typically be as much as one kilometre, and, without this constituting a standard, a number of plants include two parallel series comprising 288 tanks, each of the series being served by eight identical complex machines which carry all the tools needed for the operation of said plant and which secure: the change of the anodes, which process includes:

the pricking of the surface crust forming on the upper surface of each of the tanks, that is to say the breaking of this crust, the collecting of all or some of the pieces coming from the breaking of said crust, the actual pulling-out of the spent anodes, the fitting of fresh anodes;

- the lifting of the anode frames, this being necessary due to the wear of the said anodes over time;
- the operations of removing excess material from the bath of molten cryolite and of tapping off the molten aluminium obtained;
- and finally, the ancillary maintenance operations and corrective actions during operation.

Within plants known at the present time, the operating principle of which is illustrated diagrammatically with regard to FIG. 1, these machines (5) operate in a "slidewise" to-and-fro movement. FIG. 1 therefore shows four successive zones (11) representing four movements of each of the two machines (5) illustrated in this figure.

As indicated above, each of said machines (5) is capable of carrying out all the tasks corresponding to the functions needed for the correct operation of the plant. More specifically, a machine (5) carries out, during a first movement over a zone (11) of tanks to which it is assigned, one and the same defined task, so that it repeats this task at each tank. Said machine is then moved to the starting tank of the zone (11) in question so as to carry out a second task, different from the first, and the cycle is thus repeated for the various tasks necessary for the operation of the plant.

Thus, for the plant described above having 288 tanks, eight machines thus carry out the forward-and-return movements, and therefore the slidewise operation, in order for these various tasks to be accomplished.

Although, from the standpoint of the actual technical result, the mode of operation of this type of plant is satisfactory, it is accompanied, however, by drawbacks of a functional or structural nature which are recalled below.

Firstly, the tools of each machine have an insufficient utilization factor, consequently entailing an increased requirement in terms of machines. Moreover, because of their multitask function, these machines necessarily mean that the elements of which they are composed are overdesigned so as to be able to accomplish the tasks requiring high levels of technical performance and characteristics.

Next, this mode of operation leads to a complexity in the technical organization of the machines which is unfavourable to automation of the functions. This complexity of organization also results in the use of heavy and bulky machines, increasing the cost of manufacturing the machines, but also the more general civil engineering costs associated with the size of the buildings and of the factories in which such plants are mounted.

Finally, such an organization means that there have to be more operators, since it is necessary for someone to be in the cabin to control the machine and for someone to be on the ground to carry out the attendant manual operations, which furthermore involve safety problems.

In other words, the use of multifunctional or multitask machines limits the number of tanks capable of being treated by the same machine, given the operating process employed, in fact additionally increasing the operating costs of the plant in question.

This increase in the costs is therefore firstly inherent in the low utilization factor of the too numerous elementary functions for one and the same machine. It therefore concerns three main elements impacting the engineering of this type of plant, namely:

the handling equipment;

the mode of managing the plant;

the design and engineering of the plant.

The so-called "slidewise" operation associated with such universal machines therefore involves, apart from the overall costs of very substantial and very heavy equipment, also very high running costs.

SUMMARY OF THE INVENTION

The object of the present invention is therefore to optimize the equipment, starting by increasing their productivity and, as a corollary, decreasing both the operating costs and the costs of constructing the plants of the type in question.

The invention therefore relates firstly to a method of managing the operation of a plant for the production of aluminium by igneous electrolysis, of the type having two electrolysis tankrooms, that is to say two series of mutually parallel and symmetrical tanks with respect to a central passageway in which the handling of a ladle for pouring molten cryolite and of a liquid-aluminium tapping ladle are in particular carried out, and in which the two electrolysis tankrooms are supplied with electricity in series.

This method consists in carrying out the various handling operations at each of the tanks, necessary for the operation of the plant, in a closed loop, the members needed for said operation being moved over all the tanks of the electrolysis tankrooms in continuous cycles always in the same direction.

Thus, said members are moved in the first tankroom in a defined direction as far as the end of said tankroom, are then transferred to the adjacent end of the parallel tankroom, hereafter called the second tankroom, are then moved in said second tankroom in the opposite direction with respect to the direction of movement adopted in said first tankroom and finally are transferred to said first tankroom, in order thus to repeat the various cycles necessary for the operation of the plant.

Thus, each of these members carries out a smaller number of operations than in the scope of the plants of the prior art, these operations being repeated from one tank to another, the members circulating constantly in the same direction as far as the end of the tankrooms, where they are transferred to the parallel tankroom by means of a transfer crane or transferring crane.

In other words, the invention consists in ensuring that the movement of the members necessary for the operation of the plant proceeds in a cyclic fashion, said plant operating in a rotating flow involving said members.

This being so, it becomes possible to separate the functions at the members and no longer to use a multifunctional machine which, as was demonstrated, results in a low utilization factor and its corollary, namely an increase in the investment and running costs and the civil engineering costs.

Thus, this mode of operation makes it possible to improve the productivity and profitability, reducing non-productive time and ensuring that the members or machines are running to their full capacity, and requiring less equipment in reserve for preparing for possible machine downtime during operation.

Moreover, each type of specialized machine or member is characterized by dimensions, volumes and weights which are less than those of the multifunctional machines of the prior art. It therefore follows that there is a possibility of reducing the volumes and dimensions of the buildings intended to house this type of plant, but also of reducing the design of the structural elements, hence a significant reduction in the investment costs.

Advantageously, according to a first characteristic of the invention, the members are monofunctional. In order to optimize the operation of the plant, especially when long series of tanks are employed, these monofunctional members operate in series or trains of several members.

According to another embodiment of the invention, the members are multifunctional and advantageously divided into two fundamental machines, respectively a machine for handling the anodes, picking the surface crust, pulling out the spent anodes, cleaning the cavity of the tank, fitting the fresh anodes, with the possibility of reconditioning the anodes, and a machine of more generalistic operation for handling the aluminium tapping ladle and for handling the beam for lifting the anode frames at the tanks, and also carrying out ancillary work. The plant is therefore provided with a series of pairs each consisting of these two types of machine, always operating in a closed cycle.

Finally, the invention relates to the plant for implementing this method.

BRIEF DESCRIPTION OF THE DRAWINGS

The manner in which the invention can be carried out and the advantages which stem therefrom will be more clearly apparent from the illustrative example which is given by way of non-limiting indication, together with the appended figures.

DESCRIPTION OF A PREFERRED EMBODIMENT

Figure 1:
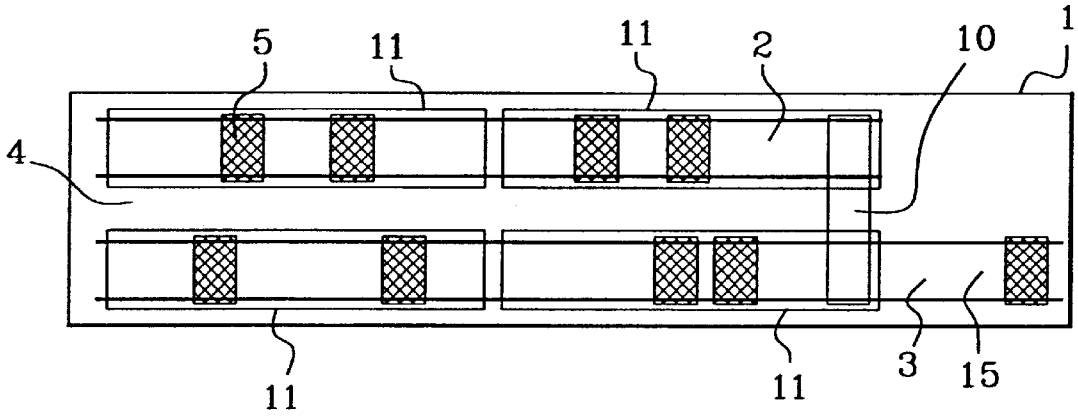
Fig. 1 PRIOR ART
FIG. 1 is a schematic representation, illustrating, as already stated, the mode of operation of the plants of the prior art.
Figure 2:
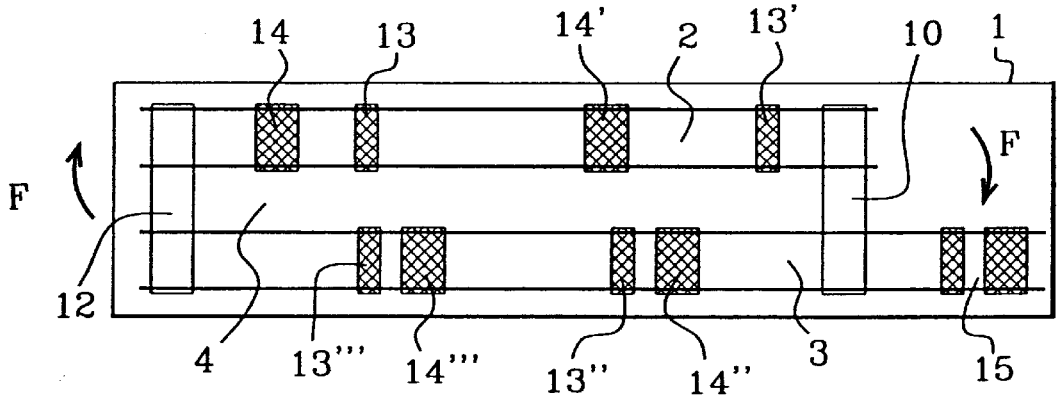
FIG. 2 is a schematic representation illustrating the principle of operation of the plant according to the invention.

FIG. 2 relates to the actual invention, and especially to the method of managing the operation of a plant for the production of aluminium using the technology of igneous electrolysis.

The plant of the type in question is installed in a building represented by the general reference (1) and may comprise a single building or two separate buildings. It incorporates two tankrooms, respectively (2) and (3), each having a series of electrolysis tanks mounted so as to be parallel to each other and mutually symmetrical with respect to a central passageway (4) bounded by the two tankrooms. This central passageway is used, in a known manner, as a zone for installing the device for feeding said tanks with alumina (alumina hopper) and, moreover, for receiving the installation of a system for capturing and processing the fume, especially the gases resulting from the electrolysis reaction (especially carbon monoxide and dioxide, oxygen and fluorinated emissions).

These tanks are largely identical, one with respect to another, and include the elements necessary for their operation. In particular, they receive the molten electrolysis bath consisting of molten alumina and cryolite.

According to an essential characteristic of the invention, the machines carrying out the operation of the plant work in a closed loop in both series of tanks (2) and (3). In the plant described, five pairs of two machines (13, 14) have been represented, thus operating in a closed loop. More specifically, four of these pairs, (13, 14) , (13', 14') , (13", 14") and (13'", 14'"), are operational, the final pair illustrated in the maintenance zone (15) not being called upon to operate during the normal operation of the plant and being intended only to allow replacement during a malfunction or a breakdown of one of the pairs.

Each of the pairs consists of two different machines, respectively a machine for handling the anodes (13) and a machine (14) for carrying out the other tasks necessary for the operation of the plant, and especially the handling of the tapping ladle and the lifting of the anode frames.

Figure 3:
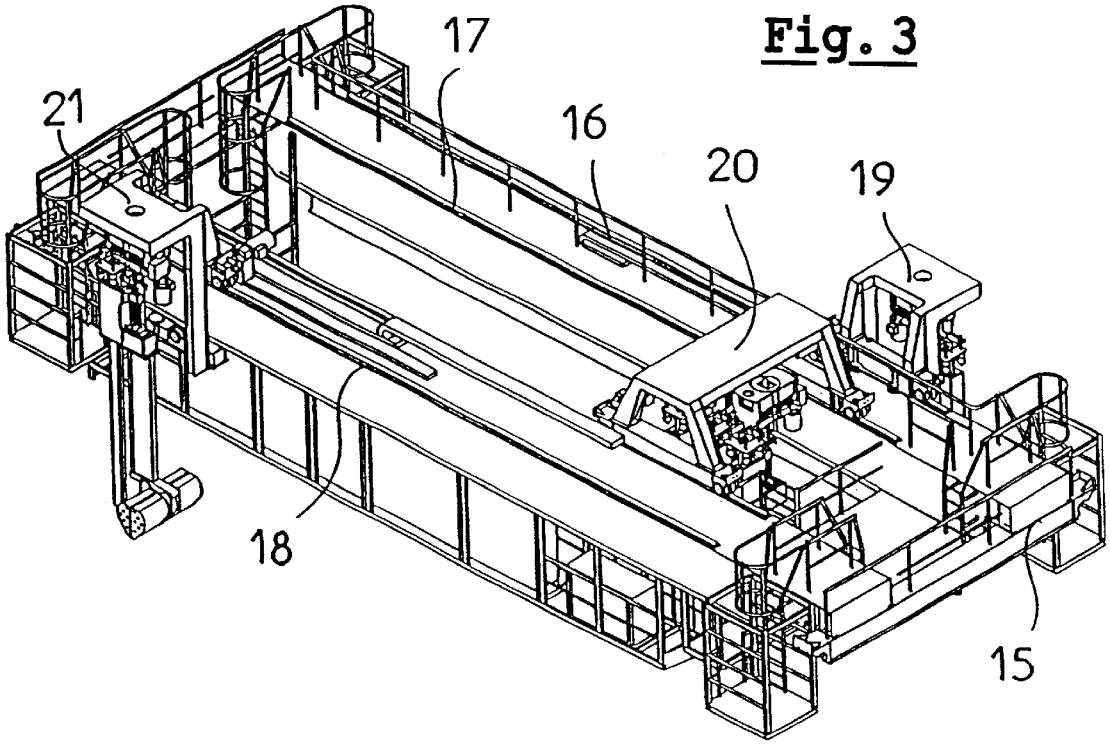
FIG. 3 is a schematic perspective representation, illustrating the machine for handling and lifting the anodes, of the type employed in the invention.
Figure 4:
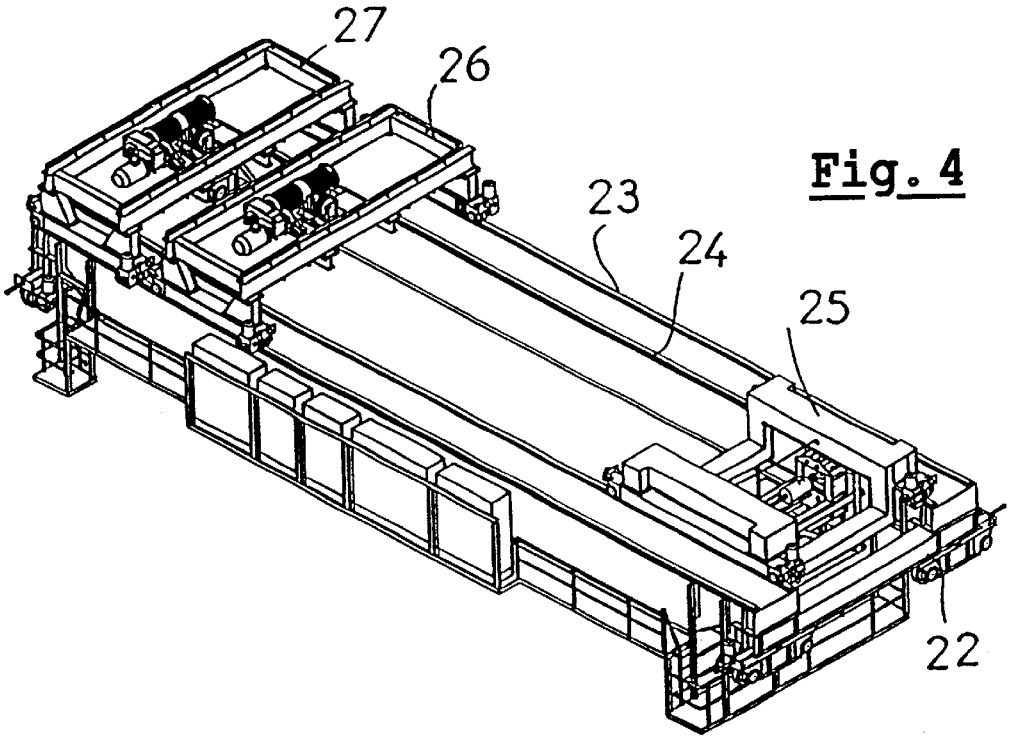
FIG. 4 is a schematic perspective representation illustrating the multitask machine for handling the tapping ladle, of the type employed in the invention.

These machines have been illustrated in greater detail in FIGS. 3 and 4.

The machine (13) will be described briefly, given that it forms the subject of a prior patent application EP 99420037.6 by the applicants incorporated herewith by reference.

Nevertheless, it should be recalled that it fundamentally consists of an overhead crane (15) intended to move over the series of tanks. This overhead crane has various running tracks, (16), (17) and (18) respectively, oriented so as to be perpendicular to the direction of movement of the crane (15), each of the aforementioned running tracks being intended to accommodate a crab carrying the members that carry out the various functions.

Thus the running track (16) accommodates a crab (19) intended to house a lifting tool, on the end of which is mounted a tool for picking the surface crust present on the upper surface of each of the tanks.

The running track (17) accommodates a crab (20), which also houses a lifting machine provided at its free end with a tool intended to pull out the spent anodes. This crab (20) is also intended to fit the fresh anodes with, as a corollary, the possibility of reconditioning the anodes.

Finally, the running track (18) accommodates a crab (21) intended to house a lifting machine carrying a tool for cleaning the cavity of the tank.

These three crabs (19), (20) and (21) are capable of operating independently of each other. It should therefore be understood that this machine(13) can carry out several tasks and that, for example, at a tank No. n, it can carry out the picking function while at tank No. (n+2) it carries out, for example, the function of pulling out the spent anodes and, at tank No. (n+1), the function of cleaning the cavity of the tank, the machine (13') that has preceded it at this tank having already carried out the prior pricking function.

The machine(14) is described in greater detail in conjunction with FIG. 4. It will be described briefly, given that it forms the subject of a patent application FR 99.14580 of one of the Applicants, and incorporated herewith by reference.

It should simply be recalled that it generally consists of an overhead crane (22) capable of moving on the same running track as that accommodating the crane (15). This overhead crane (22) has two parallel running tracks (23) and (24), oriented perpendicular to the direction of movement of the crane (22).

The inner running track (24) is intended to accommodate a crab (25) intended for carrying out the handling of the alumina tapping. Typically, it has a lifting capacity of the order of 20 to 40 tonnes.

The outer running track (23) is intended to accommodate two crabs (26) and (27), which are more or less identical, capable of passing over the crab (25) and intended, especially when they operate simultaneously, for lifting the anode frames. Furthermore, when they operate individually, they are intended to carry out the auxiliary work such as, for example, the handling of the point feeder-breaker, the inter-tank slabs during the shut-down of a tank, as well as all the accessories useful for this operation such as those used for restarting a tank.

Whether the machine (13) or the machine (14) is involved, these being designed symmetrically, it will be understood that, because of their structure and their architecture, they can equally well operate in the first electrolysis tankroom (2) or the second electrolysis tankroom (3).

This is because, with regard to the machine (13), given on the one hand the operating independence of the various crabs that it supports and on the other hand the non-competing nature of the corresponding running tracks, nothing prevents this machine being adapted to each of the two tankrooms (2, 3) given that, furthermore, said machine (13) does not interfere with the handling of the tapping ladle moving in the central passageway (4).

With regard to the machine (14), given the possibility offered to the crab (25) for handling the tapping ladle of crossing the crabs (26) and (27) for lifting the anode frames, by passing underneath the latter, it can perfectly interfere with the tapping ladle in the central passageway, whatever the series of tanks in which it is located.

Figure 5:
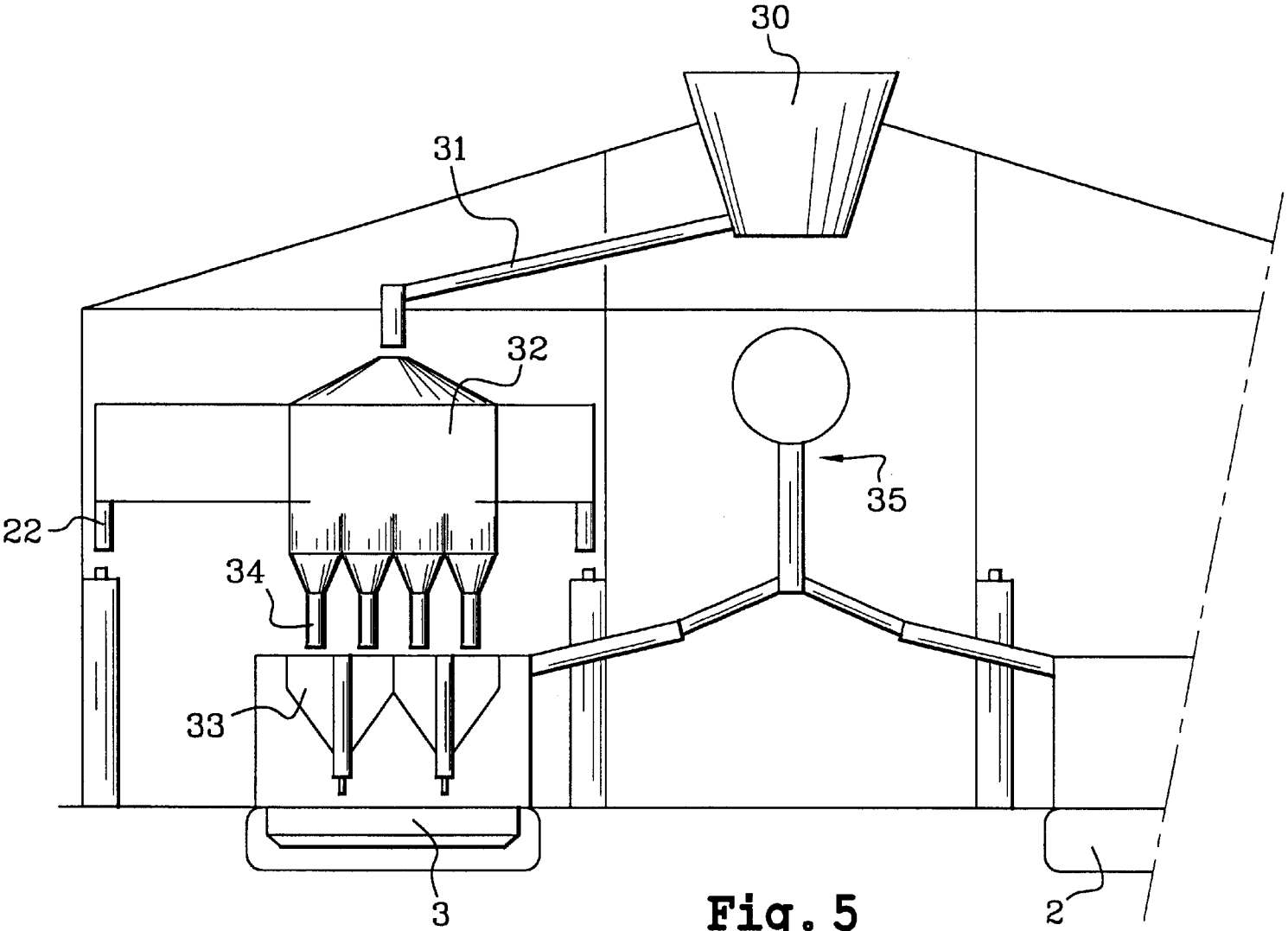
FIG. 5 is a view in cross section of a plant according to the invention, in which two tankrooms may be seen.

These machines (13, 14 etc.) are also capable of feeding the tanks with alumina. FIG. 5 shows symbolically a view in cross section of a plant according to the invention, in which the two tankrooms may be seen. In the central position, and placed over the top of said tankrooms so as not to interfere with the system (35) for capturing the fume resulting from the electrolysis reaction, is a fixed alumina hopper (30), fitted into the roof in the central region of the building, which hopper serves as a buffer container for feeding the machines (14, 14', 14", 14'") travelling in this tankroom.

A pipe (31) extends from said hopper (30) so as to allow the machines (14) to be fed with molten alumina. To do this, said machines are brought to the end of said hopper so as to carry out the process of recharging with alumina. More specifically, the machines (14) are provided with a secondary hopper (32) incorporated into the beam of the crane supporting one of the parts of the running tracks (23, 24), capable of being positioned under the end of the pipe (31). These secondary hoppers (32) are themselves provided with a system for filling the tanks (33), this system being associated with hoppers (34) with which the tanks themselves are associated.

The secondary hoppers (32) have an alumina storage capacity of approximately 15 to 20 tonnes, depending on the actual capacity of the hoppers (34) of each tank, on the filling periodicity of said tanks, and on the number of tanks to be served between two fillings of the secondary hoppers (32).

Thus, in order not to increase the occupation time of the machines (14), it may be advantageous to ensure that the operation of filling a tank with alumina takes place during tapping (that is to say the collecting of liquid aluminium) which takes place in the adjacent tank. Synchronization of these two operations is firstly made possible because of the fact that the time to fill a tank with alumina is shorter than the time to tap the aluminium. Furthermore, since the spacing between two consecutive tanks in the same tankroom is constant, the overhead-crane structure making up the machines (14) is produced in such a way that, when such a machine is placed in the tapping position at one tank, the filling mouth of the adjacent tank coincides with the alumina hopper (32) of said machine (14). As illustrated in FIG. 2, the machines (13) and (14), or respectively (13', 13", 13'") and (14', 14", 14'"), are capable of being transferred from one electrolysis tankroom to the other by means of transferring cranes, schematically represented by the references (10) and (12) and positioned at the two ends of the two tankrooms.

Admittedly, although the use of a transferring crane (10) is known, its purpose hitherto was limited to carrying out the maintenance and repair operations on the handling machines in the maintenance zone (15), by transferring said machines to this point, as well as the operations of transferring the tanks to the corresponding maintenance zone.

In the plant according to FIG. 2, the transferring crane (10) is intended to allow the machines (13, 14 13', 14'; 13", 14"; 13'", 14'") to be transferred when they come to the end of their travel in the tankroom (2), therefore to the right in FIG. 2, into the second tankroom (3), while the transferring crane (12) is itself intended to allow said machines to be transferred into said first tankroom (2) when they reach the left-hand end in FIG. 2, so as to ensure closed-loop cycling of the travel of said machines as shown by the arrows F indicated in this figure.

It should consequently be understood that, compared with the prior art, the machines are to some extent specialized in such a way as to give them a better utilization factor. This is because each of the machines (13, 13', 13", 13'") provides a different function or task as it progresses along the series of tanks. The same applies to the machines (14, 14', 14", 14'").

Thus, because of this specialization, it becomes unnecessary to overdesign the elements making up these machines, resulting in a reduction in the engineering costs relating especially to the running tracks intended to support these machines.

Thus, the cost of producing a pair of machines (13, 14) proves to be less than the cost corresponding to the production of a multifunction machine of the prior art, while still fulfilling the same functions or equivalent functions.

Moreover, it also becomes easier to automate the operation of these machines because each tool has only to be moved in space in a combination of three linear movements in order to serve each tank. Since each tool has its own rotation, this considerably simplifies the constraints on positioning the machine over the tank.

The end result is in fact a continuous rotation of the operating machines (13) and (14).

The so-called "slidewise" to-and-fro movement of the plants of the prior art has thus been replaced by a continuous flow of the said machines in a closed loop, each set of machines, associated in the example described in pairs, working from the first tank to the last tank of the loop thus formed, continuously, owing to the use of the two transferring cranes.

In one specific embodiment, such as the one mentioned in the preamble of the present application, and comprising 288 tanks divided into two series of tanks of 144 tanks, and taking into account the necessary cycle times, optimizing the number of machines results in each batch being defined per pair of machines, as illustrated in FIG. 2.

The eight machines of the prior art are replaced by four pairs of more specialized machines.

This novel method of managing and organizing in rotating flow eliminates the considerable non-productive time when changing the function of said machines, as well as the time needed to return the machines during their slidewise operation.

It furthermore favours the specialization of the operators and also allows automation of the functions. Overall productivity is therefore markedly improved.

Finally, it allows the costs of manufacturing such plants to be drastically reduced.

What is claimed is:

1. A method for managing the operation of a plant for the production of aluminum by igneous electrolysis, wherein the plant comprises two electrolysis tankrooms, each tankroom having a series of tanks, said tankrooms being mutually parallel and symmetrical with respect to a central passageway disposed therebetween, wherein the handling of liquid-aluminum tapping ladles is carried out within said central passageway, and wherein said method comprises the performance of various necessary handling operations at each of the tanks in a closed loop configuration, wherein members needed for said operations are moved over the entirety of the tanks in the two tankrooms in continuous cycles.

2. The method of claim 1, wherein the members needed for said operation are moved in the first tankroom in a defined direction as far as the end of said tankroom, are then transferred to the adjacent end of the parallel tankroom, called the second tankroom, are then moved in said second tankroom in the opposite direction with respect to the direction of movement adopted in said first tankroom and finally are transferred to said first tankroom, in order thus to repeat the various cycles necessary for the operation of the plant.

3. The method of claim 1 wherein the members needed for said operation are monofunctional.

4. The method of claim 3, wherein the monofunctional members operate in series or trains of several members.

5. The method of claim 1, wherein the members needed for said operation are multifunctional.

6. The method of claim 5, wherein some of the members consist of anode-handling machines, and carry out the following functions:

the pricking of the surface crust forming on the upper surface of each of the tanks, that is to say the breaking of this crust;

the collecting of all or some of the pieces coming from the breaking of said crust;

the actual pulling-out of the spent anodes;

the fitting of fresh anodes.

7. The method of claim 5, wherein some of the members fulfil more generalistic operations, and namely carry out the following functions:

the lifting of the anode frames;

the operations of adding alumina into the tanks and of tapping off the liquid aluminium obtained;

the ancillary maintenance operations and corrective actions during operation.

8. The method of claim 5, wherein the anode-handling machines and the members fulfilling more generalistic operations are moved in pairs.

9. The method of claim 5, wherein the machines are periodically filled with molten alumina from a central hopper so as to allow the electrolysis tanks to be filled after they have been tapped of liquid aluminium.

10. The method of claim 9, wherein the filling of one tank with molten alumina by one of the machines takes place simultaneously with the tappering of the adjacent tank of liquid aluminium by means of the same machine.

11. A plant for the production of aluminium by igneous electrolysis, comprising:

two electrolysis tankrooms, each having a series of electrolysis tanks, said tankrooms being symmetrical with respect to a central passageway in which the handling of a molten-aluminium tapping ladle is carried out;

wherein each of said series of tanks are surmounted by a plurality of pairs of machines respectively:

for handling the anodes, carrying out the following functions:

the pricking of the surface crust forming on the upper surface of each of the tanks, that is to say the breaking of this crust, the collecting of all or some of the pieces coming from the breaking of the said crust, the actual pulling-out of the spent anodes, the fitting of fresh anodes;

for handling the tapping ladle, carrying out the following functions:

the lifting of the anode frames;

the operations of adding alumina into the tanks and of tapping off the liquid aluminium obtained, the ancillary maintenance operations and corrective actions during operation;

wherein the two series of tanks are surmounted at their two ends by a transferring crane capable of allowing the machines to be transferred from one tankroom to the parallel tankroom in a closed-loop cycle;

and wherein said machines are moved in pairs above the tanks.

12. The plant of claim 11, wherein the machines are furthermore provided with secondary hoppers intended to be periodically filled with molten alumina from a central hopper and intended to fill the electrolysis tanks after they have been tapped of liquid aluminium.

13. A plant for the production of aluminium by igneous electrolysis, comprising:

two electrolysis tankrooms, each having a series of electrolysis tanks, said tankrooms being symmetrical with respect to a central passageway in which the handling of a molten-aluminium tapping ladle is carried out;

wherein each of said series of tanks are surmounted by a plurality of pairs of machines;

wherein the two series of tanks are surmounted at their two ends by a transferring crane capable of allowing the machines to be transferred from one tankroom to the parallel tankroom in a closed-loop cycle;

and wherein said machines are moved in pairs above the tanks.

* * * * *

UNITED STATES PATENT AND TRADEMARK OFFICE

CERTIFICATE OF CORRECTION

PATENT NO. : 6,319,388 B1
DATED : November 20, 2001
INVENTOR(S) : Piron et al.

It is certified that error appears in the above-identified patent and that said Letters Patent is hereby corrected as shown below:

Title page,
Item [73] change the Assignee names from "ACIS" to -- Reel SA and ACIS --.

Signed and Sealed this

Fourteenth Day of May, 2002

*Attest:*

*Attesting Officer*

JAMES E. ROGAN
*Director of the United States Patent and Trademark Office*